US007965970B2

(12) United States Patent
Haseba et al.

(10) Patent No.: US 7,965,970 B2
(45) Date of Patent: Jun. 21, 2011

(54) FIXING DEVICE AND IMAGE FORMING APPARATUS

(75) Inventors: Shigehiko Haseba, Ebina (JP); Kiyoshi Iwai, Ebina (JP); Masakatsu Eda, Ebina (JP); Motoi Noya, Ebina (JP); Takayuki Uchiyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 85 days.

(21) Appl. No.: 12/556,165

(22) Filed: Sep. 9, 2009

(65) Prior Publication Data

US 2010/0247183 A1 Sep. 30, 2010

(30) Foreign Application Priority Data

Mar. 27, 2009 (JP) ..... 2009-080334

(51) Int. Cl.
*G03G 15/20* (2006.01)

(52) U.S. Cl. ..... 399/329

(58) Field of Classification Search ..... 399/69, 399/328, 329, 330, 333
See application file for complete search history.

(56) References Cited

U.S. PATENT DOCUMENTS

| | | | | |
|---|---|---|---|---|
| 5,970,299 | A * | 10/1999 | Sano et al. | 399/330 |
| 6,021,303 | A | 2/2000 | Terada et al. | 399/328 |
| 6,505,027 | B2 * | 1/2003 | Takeuchi et al. | 399/328 |
| 6,713,734 | B2 * | 3/2004 | Suzuki | 399/328 X |
| 6,819,904 | B2 * | 11/2004 | Terada et al. | 399/328 |
| 7,020,426 | B2 * | 3/2006 | Takagi et al. | 399/330 |
| 7,424,259 | B2 * | 9/2008 | Samei et al. | 399/329 |
| 2008/0124111 | A1 | 5/2008 | Baba et al. | |
| 2008/0124147 | A1 | 5/2008 | Uehara et al. | |
| 2008/0205948 | A1 * | 8/2008 | Baba et al. | 399/329 |
| 2008/0226324 | A1 * | 9/2008 | Baba et al. | 399/69 |

FOREIGN PATENT DOCUMENTS

| | | |
|---|---|---|
| JP | 08-235820 | 9/1996 |
| JP | 10-282829 | 10/1998 |
| JP | 2002-311735 | 10/2002 |
| JP | 3988251 | 10/2007 |
| JP | 2008-129517 | 6/2008 |
| JP | 2008-152247 | 7/2008 |

* cited by examiner

*Primary Examiner* — Sandra L Brase
(74) *Attorney, Agent, or Firm* — Morgan, Lewis & Bockius LLP

(57) ABSTRACT

The fixing device includes: a fixing member including a conductive layer and fixing toner onto a recording medium with the conductive layer self-heated by electromagnetic induction; a drive unit rotationally driving the fixing member; a magnetic field generating member generating an alternate-current magnetic field intersecting with the conductive layer; a magnetic path forming member being in contact with an inner peripheral surface of the fixing member, forming a magnetic path of the alternate-current magnetic field, and transmitting heat to the fixing member by being self-heated by electromagnetic induction; an induction member that is in contact with an inner peripheral surface of the magnetic path forming member, that induces magnetic field lines and that diffuses heat; and an elastic member having force in a direction to press the magnetic path forming member and the induction member against the inner peripheral surface of the fixing member.

11 Claims, 10 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Application No. 2009-080334 filed Mar. 27, 2009.

BACKGROUND

1. Technical Field

The present invention relates to a fixing device and an image forming apparatus.

2. Related Art

Fixing devices using an electromagnetic induction heating system are known as the fixing devices each installed in an image forming apparatus, such as a copy machine and a printer, using an electrophotographic system.

SUMMARY

According to an aspect of the present invention, there is provided a fixing device including: a fixing member that includes a conductive layer and that fixes toner onto a recording medium with the conductive layer self-heated by electromagnetic induction; a drive unit that rotationally drives the fixing member; a magnetic field generating member that generates an alternate-current magnetic field intersecting with the conductive layer of the fixing member; a magnetic path forming member that is arranged so as to be in contact with an inner peripheral surface of the fixing member, that forms a magnetic path of the alternate-current magnetic field generated by the magnetic field generating member, and that transmits heat to the fixing member by being self-heated by electromagnetic induction; an induction member that is arranged so as to be in contact with an inner peripheral surface of the magnetic path forming member, that induces magnetic field lines having passed through the magnetic path forming member and that diffuses heat generated at the magnetic path forming member; and an elastic member that has force in a direction to press the magnetic path forming member and the induction member against the inner peripheral surface of the fixing member.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below in detail with reference to the accompanying drawings.

<Description of Image Forming Apparatus>

Figure 1:
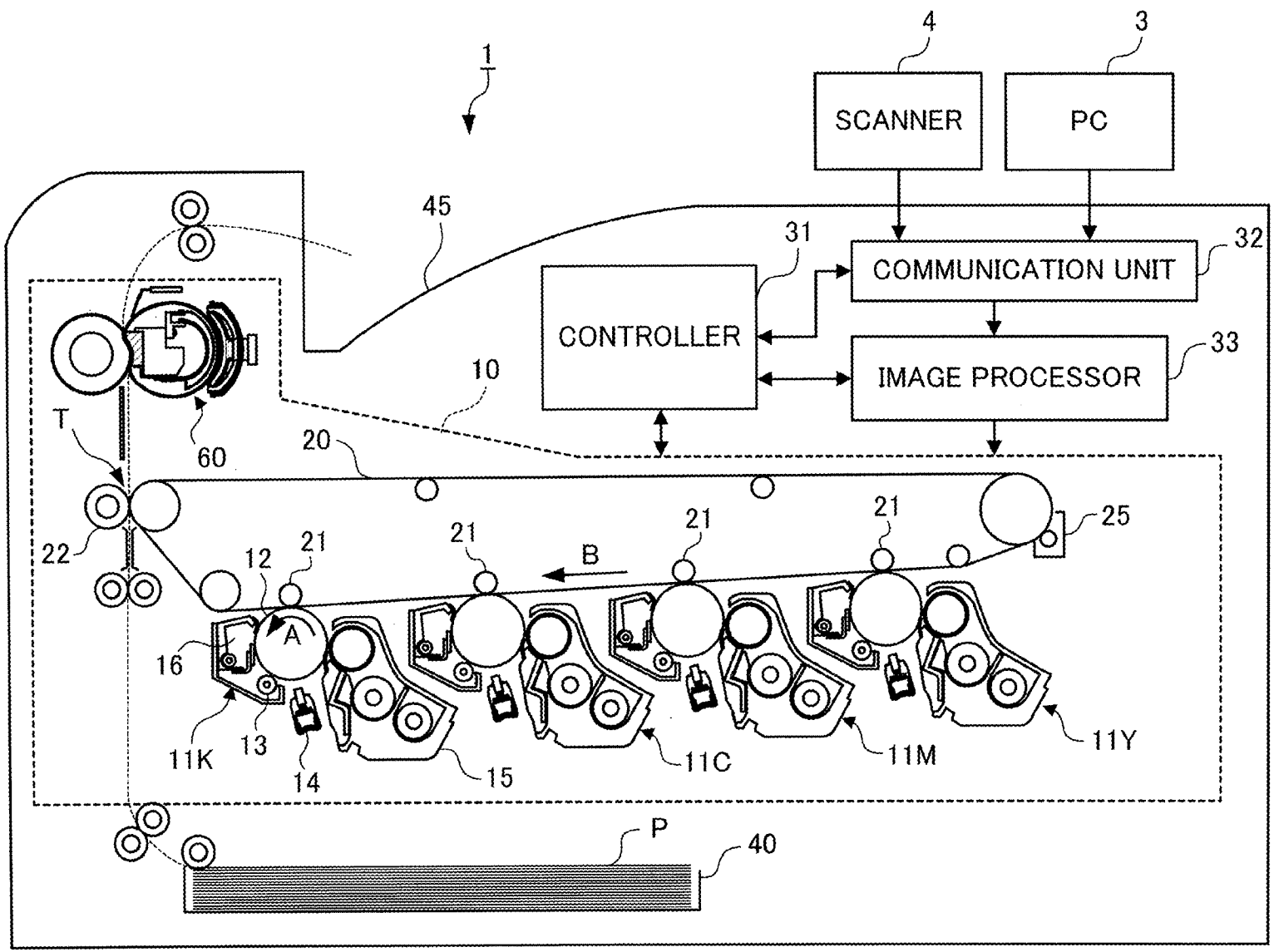
FIG. 1 is a diagram showing a configuration example of an image forming apparatus to which a fixing device of the exemplary embodiment is applied.

FIG. 1 is a diagram showing a configuration example of an image forming apparatus to which a fixing device of the exemplary embodiment is applied. An image forming apparatus 1 shown in FIG. 1 is a so-called tandem-type color printer, and includes: an image formation unit 10 that performs image formation on the basis of color image data; and a controller 31 that controls operations of the entire image forming apparatus 1. The image forming apparatus 1 further includes: a communication unit 32 that communicates with, for example, a personal computer (PC) 3, an image reading apparatus (scanner) 4 or the like to receive image data; and an image processor 33 that performs image processing set in advance on image data received by the communication unit 32.

The image formation unit 10 includes four image forming units 11Y, 11M, 11C and 11K (also collectively referred to as an "image forming unit 11") as an example of toner image forming units that are arranged side by side at certain intervals. Each of the image forming units 11 includes: a photoconductive drum 12 as an example of an image carrier that forms an electrostatic latent image and holds a toner image; a charging device 13 that uniformly charges the surface of the photoconductive drum 12 at a potential set in advance; a light emitting diode (LED) print head 14 that exposes, on the basis of color image data, the photoconductive drum 12 charged by the charging device 13; a developing device 15 that develops the electrostatic latent image formed on the photoconductive drum 12; and a drum cleaner 16 that cleans the surface of the photoconductive drum 12 after the transfer.

The image forming units 11 have almost the same configuration except toner contained in the developing device 15, and form yellow (Y), magenta (M), cyan (C) and black (K) color toner images, respectively.

Further, the image formation unit 10 includes: an intermediate transfer belt 20 onto which multiple layers of color toner images formed on the photoconductive drums 12 of the image forming units 11 are transferred; and primary transfer rolls 21 that sequentially transfer (primarily transfer) color toner images formed in respective image forming units 11 onto the intermediate transfer belt 20. Furthermore, the image formation unit 10 includes: a secondary transfer roll 22 that collectively transfers (secondarily transfers) the color toner images super imposingly transferred onto the intermediate transfer belt 20 onto a sheet P which is a recording medium (recording sheet); and a fixing unit 60 as an example of a fixing unit (a fixing device) that fixes the color toner images having been secondarily transferred, onto the sheet P. Note that, in the image forming apparatus 1 according to the present exemplary embodiment, the intermediate transfer belt 20, the primary transfer rolls 21 and the secondary transfer roll 22 configure a transfer unit.

In the image forming apparatus 1 of the present exemplary embodiment, image formation processing using the following processes is performed under operations controlled by the controller 31. Specifically, image data from the PC 3 or the scanner 4 is received by the communication unit 32, and after the image data is subjected to predetermined image processing performed by the image processor 33, the image data of each color is generated and sent to a corresponding one of the image forming units 11. Then, in the image forming unit 11K that forms a black-color (K) toner image, for example, the photoconductive drum 12 is uniformly charged by the charging device 13 at the potential set in advance while rotating in a direction of an arrow A, and then is exposed by the LED print head 14 on the basis of the K color image data transmitted from the image processor 33. Thereby, an electrostatic latent image for the black-color image is formed on the photoconductive drum 12. The black-color electrostatic latent image formed on the photoconductive drum 12 is then developed by the developing device 15. Then, the black-color toner image is formed on the photoconductive drum 12. In the same manner, yellow (Y), magenta (M) and cyan (C) color toner images are formed in the image forming units 11Y, 11M and 11C, respectively.

The color toner images formed on the respective photoconductive drums 12 in the image forming units 11Y, 11M and 11C are electrostatically transferred (primarily transferred), in sequence, onto the intermediate transfer belt 20 that moves in a direction of an arrow B by the primary transfer rolls 21. Then, superimposed toner images on which the color toner images are superimposed on one another are formed. Then, the superimposed toner images on the intermediate transfer belt 20 are transported to a region (secondary transfer portion T) at which the secondary transfer roll 22 is arranged, along with the movement of the intermediate transfer belt 20. The sheet P is supplied from a sheet holding unit 40 to the secondary transfer portion T at a timing when the superimposed toner images being transported arrive at the secondary transfer portion T. Then, the superimposed toner images are collectively and electrostatically transferred (secondarily transferred) onto the transported sheet P by action of a transfer electric field formed at the secondary transfer portion T by the secondary transfer roll 22.

Thereafter, the sheet P onto which the superimposed toner images are electrostatically transferred is transported toward the fixing unit 60. The toner images on the sheet P transported to the fixing unit 60 are heated and pressurized by the fixing unit 60 and thereby are fixed onto the sheet P. Then, the sheet P including the fixed images formed thereon is transported to a paper stack unit 45 provided at an output portion of the image forming apparatus 1.

Meanwhile, the toner (primary-transfer residual toner) attached to the photoconductive drums 12 after the primary transfer and the toner (secondary-transfer residual toner) attached to the intermediate transfer belt 20 after the secondary transfer are removed by the drum cleaners 16 and a belt cleaner 25, respectively.

In this way, the image formation processing in the image forming apparatus 1 is repeatedly performed for a designated number of print sheets.

<Description of Configuration of Fixing Unit>

Next, a description will be given of the fixing unit 60 in the present exemplary embodiment.

Figure 2:
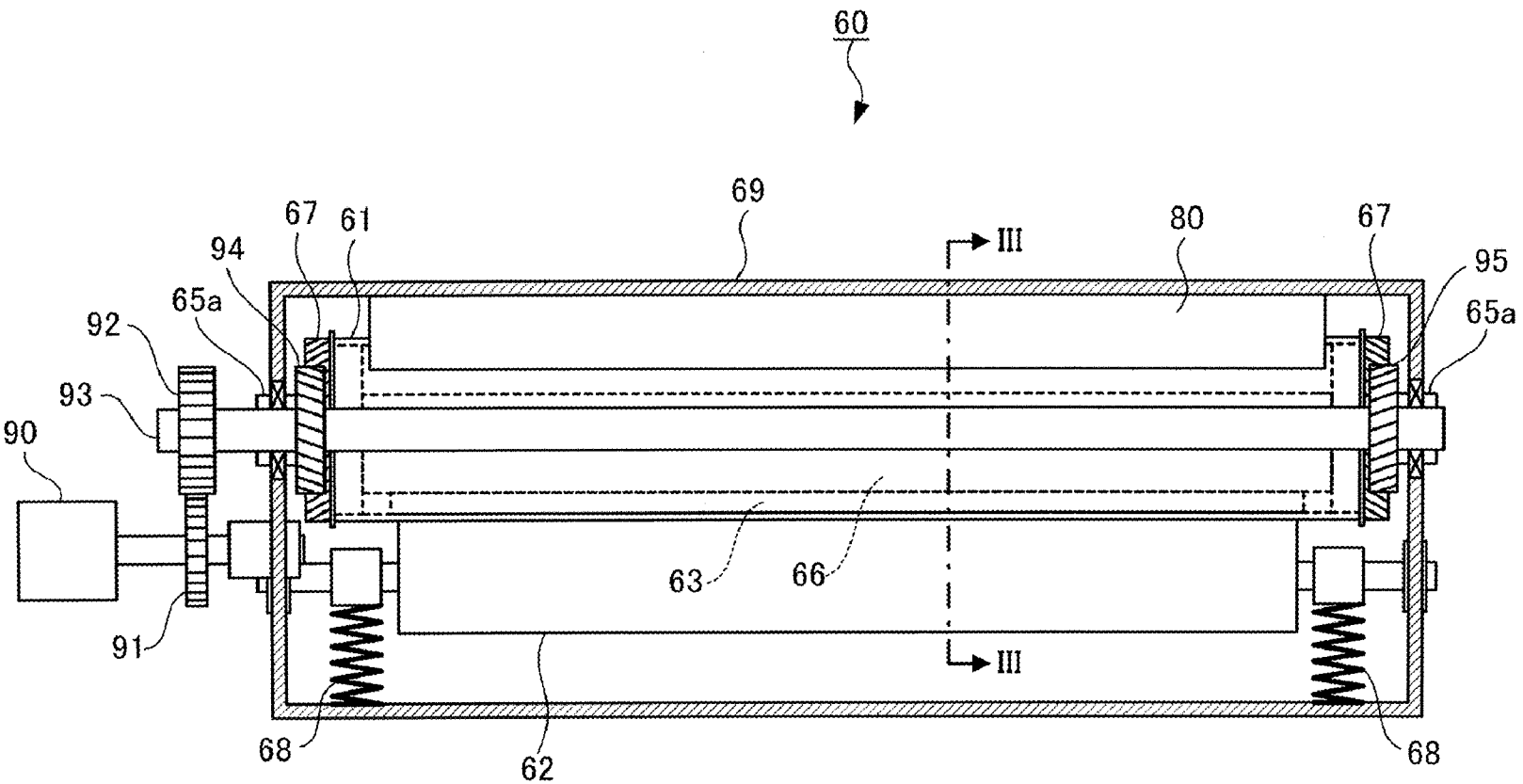
FIG. 2 is a front view of the fixing unit of the exemplary embodiment.
Figure 3:
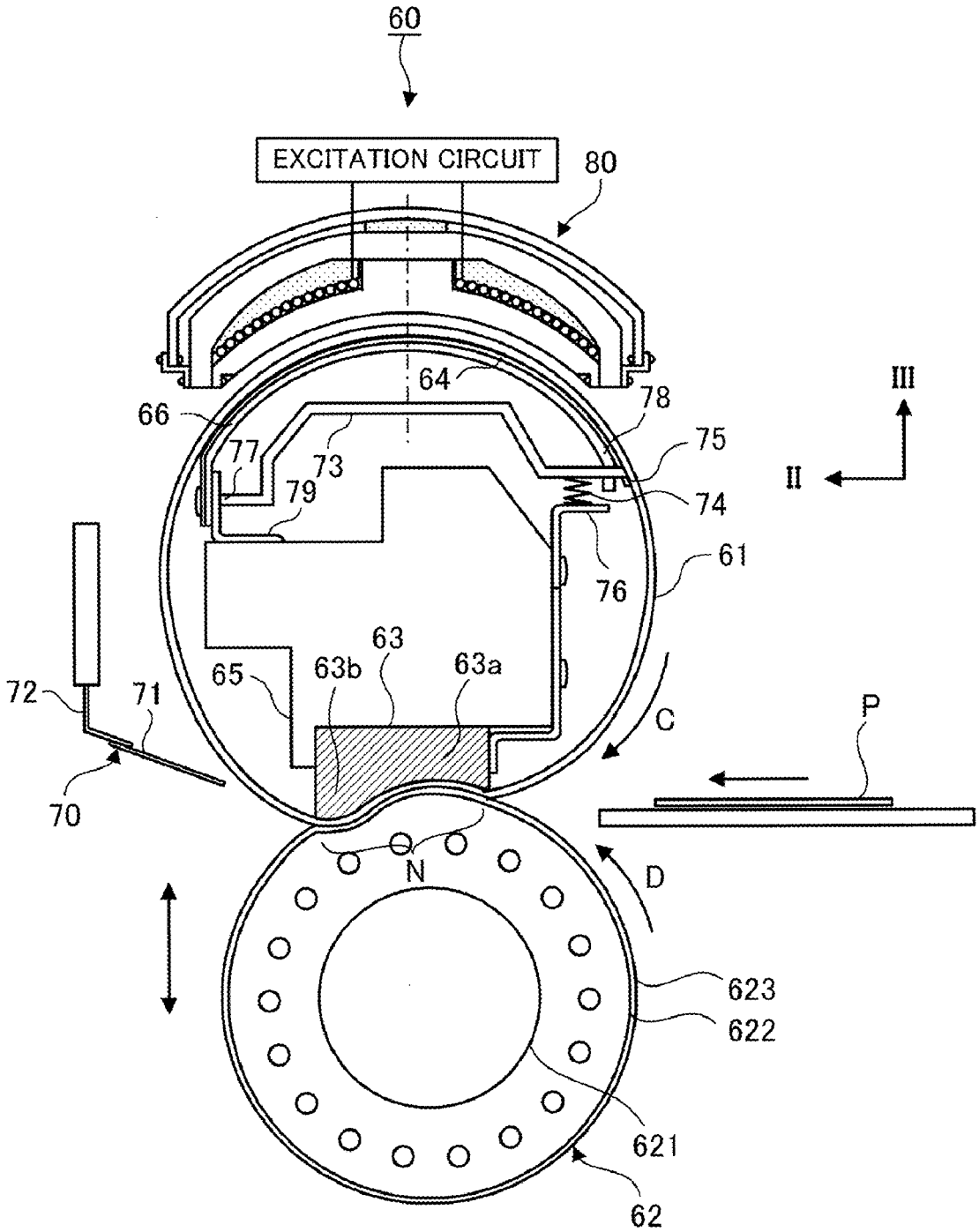
FIG. 3 is a cross sectional view of the fixing unit, taken along the line III-III in FIG. 2.

FIGS. 2 and 3 are diagrams showing a configuration of the fixing unit 60 of the exemplary embodiment. FIG. 2 is a front view of the fixing unit 60, and FIG. 3 is a cross sectional view of the fixing unit 60, taken along the line III-III in FIG. 2.

Firstly, as shown in FIG. 3, which is a cross sectional view, the fixing unit 60 includes: an induction heating (IH) heater 80 as an example of a magnetic field generating member that generates an AC (alternate-current) magnetic field; a fixing belt 61 as an example of a fixing member that undergoes electromagnetic induction heating by the IH heater 80, and thereby fixes a toner image; a pressure roll 62 as an example of a fixing and pressing member that is arranged in a manner to face the fixing belt 61; and a pressing pad 63 that is pressed by the pressure roll 62 with the fixing belt 61 therebetween.

The fixing unit 60 further includes: a frame 65 that supports a constituent member such as the pressing pad 63; a temperature-sensitive magnetic member 64 that forms a magnetic path by inducing the AC magnetic field generated at the IH heater 80; an induction member 66 that induces magnetic field lines passing through the temperature-sensitive magnetic member 64; a magnetic path shielding member 73 that prevents the magnetic path from leaking toward the frame 65; and a peeling assisting member 70 that assists peeling of the sheet P from the fixing belt 61.

<Description of Fixing Belt>

Figure 4:
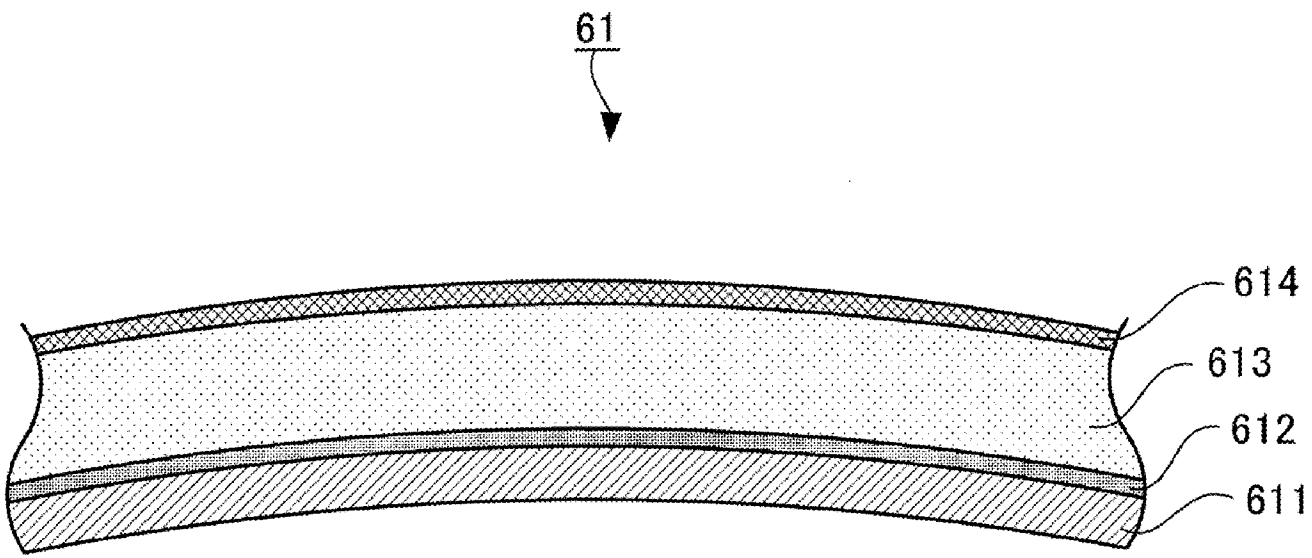
FIG. 4 is a configuration diagram showing a cross sectional layer of the fixing belt.

The fixing belt 61 is formed of an endless belt member originally formed into a cylindrical shape, and is formed with a diameter of 30 mm and a width-direction length of 370 mm in the original shape (cylindrical shape), for example. In addition, as shown in FIG. 4 (a configuration diagram showing a cross sectional layer of the fixing belt 61), the fixing belt 61 is a belt member having a multi-layer structure including: a base material layer 611; a conductive heat-generating layer 612 that is stacked on the base material layer 611; an elastic layer 613 that improves fixing properties of a toner image; and a surface release layer 614 that is applied as the uppermost layer.

The base material layer 611 is formed of a heat-resistant sheet-like member that supports the conductive heat-generating layer 612, which is a thin layer, and that gives a mechanical strength to the entire fixing belt 61. Moreover, the base material layer 611 is formed of a certain material with a certain thickness. The material has properties (relative permeability, specific resistance) that allow a magnetic field to pass therethrough so that the AC magnetic field generated at the IH heater 80 may act on the temperature-sensitive magnetic member 64. Meanwhile, the base material layer 611 itself is formed so as not to generate heat by action of the magnetic field or not to easily generate heat.

Specifically, for example, a non-magnetic metal such as a non-magnetic stainless steel having a thickness of 30 to 200 μm (preferably, 50 to 150 μm), or a resin material or the like having a thickness of 60 to 200 μm is used as the base material layer 611.

The conductive heat-generating layer 612 is an example of a conductive layer and is an electromagnetic induction heat-generating layer that generates heat by electromagnetic induction of the AC magnetic field generated at the IH heater 80. Specifically, the conductive heat-generating layer 612 is a layer that generates an eddy current when the AC magnetic field from the IH heater 80 passes therethrough in the thickness direction.

Normally, an inexpensively manufacturable general-purpose power supply is used as the power supply for an excitation circuit that supplies an AC current to the IH heater 80 (also refer to later described FIG. 6). For this reason, in general, a frequency of the AC magnetic field generated by the IH heater 80 ranges from 20 kHz to 100 kHz by use of the general-purpose power supply. Accordingly, the conductive heat-generating layer 612 is formed to allow the AC magnetic field having a frequency of 20 kHz to 100 kHz to enter and to pass therethrough.

A region of the conductive heat-generating layer 612, where the AC magnetic field is allowed to enter is defined as a "skin depth (δ)" representing a region where the AC magnetic field attenuates to 1/e. The skin depth (δ) is calculated by use of the following formula (1), where f is a frequency of the AC magnetic field (20 kHz, for example), ρ is a specific resistance value (Ω·m), and $\mu_r$ is a relative permeability.

Accordingly, in order to allow the AC magnetic field having a frequency of 20 kHz to 100 kHz to enter and then to pass through the conductive heat-generating layer 612, the thickness of the conductive heat-generating layer 612 is formed to be smaller than the skin depth (δ) of the conductive heat-generating layer 612, which is defined by the formula (1). In addition, as the material that forms the conductive heat-generating layer 612, a metal such as Au, Ag, Al, Cu, Zn, Sn, Pb, Bi, Be or Sb, or a metal alloy including at least one of these elements is used, for example.

$$\delta = 503\sqrt{\frac{\rho}{f \cdot \mu_r}} \tag{1}$$

Specifically, as the conductive heat-generating layer 612, a non-magnetic metal (paramagnetic material having a relative permeability substantially equal to 1) including Cu or the like, having a thickness of 2 to 20 μm and a specific resistance value not greater than $2.7\times10^{-8}$ Ω·m is used, for example.

In addition, in view of shortening the amount of time required for heating the fixing belt 61 to reach a fixation setting temperature (hereinafter, referred to as a "warm-up time") as well, the conductive heat-generating layer 612 may be formed of a thin layer.

Next, the elastic layer 613 is formed of a heat-resistant elastic material such as a silicone rubber. The toner image to be held on the sheet P, which is to become the fixation target, is formed of a multi-layer of color toner as powder. For this reason, in order to uniformly supply heat to the entire toner image at a nip portion N, the surface of the fixing belt 61 may particularly be deformed so as to correspond with unevenness of the toner image on the sheet P. In this respect, a silicone rubber having a thickness of 100 to 600 μm and a hardness of 10° to 30° (JIS-A), for example, may be used for the elastic layer 613.

The surface release layer 614 directly contacts with an unfixed toner image held on the sheet P. Accordingly, a material with a high releasing property is used. For example, a PFA (a copolymer of tetrafluoroethylene and perfluoroalkylvinylether) layer, a PTFE (polytetrafluoroethylene) layer or a silicone copolymer layer or a composite layer formed of these layers is used. As to the thickness of the surface release layer 614, if the thickness is too small, no sufficient wear resistance is obtained, hence, reducing the life of the fixing belt 61. On the other hand, if the thickness is too large, the heat capacity of the fixing belt 61 becomes so large that the warm-up time becomes longer. In this respect, the thickness of the surface release layer 614 may be particularly 1 to 50 μm in consideration of the balance between the wear resistance and heat capacity.

<Description of Pressing Pad>

The pressing pad 63 is formed of an elastic material such as a silicone rubber or fluorine rubber, and is supported by the frame 65 at a position facing the pressure roll 62. Then, the pressing pad 63 is arranged in a state of being pressed by the pressure roll 62 with the fixing belt 61 therebetween, and forms the nip portion N with the pressure roll 62.

In addition, the pressing pad 63 has different nip pressures set for a pre-nip region 63*a* on the sheet entering side of the nip portion N (upstream side in the transport direction of the sheet P) and a peeling nip region 63*b* on the sheet exit side of the nip portion N (downstream side in the transport direction of the sheet P), respectively. Specifically, a surface of the pre-nip region 63*a* at the pressure roll 62 side is formed into a circular arc shape approximately corresponding with the outer peripheral surface of the pressure roll 62, and the nip portion N, which is uniform and wide, is formed. Moreover, a surface of the peeling nip region 63*b* at the pressure roll 62 side is formed into a shape so as to be locally pressed with a larger nip pressure from the surface of the pressure roll 62 in order that a curvature radius of the fixing belt 61 passing through the nip portion N of the peeling nip region 63*b* may be small. Thereby, a curl (down curl) in a direction in which the sheet P is separated from the surface of the fixing belt 61 is formed on the sheet P passing through the peeling nip region 63*b*, thereby promoting the peeling of the sheet P from the surface of the fixing belt 61.

Note that, in the present exemplary embodiment, the peeling assisting member 70 is arranged at the downstream side of the nip portion N as an assistance unit for the peeling of the sheet P by the pressing pad 63. In the peeling assisting member 70, a peeling baffle 71 is supported by a frame 72 in a state of being positioned close to the fixing belt 61 in a direction opposite to the rotational moving direction of the fixing belt 61 (so-called counter direction). Then, the peeling baffle 71 supports the curl portion formed on the sheet P at the exit of the pressing pad 63, thereby preventing the sheet P from moving toward the fixing belt 61.

<Description of Temperature-Sensitive Magnetic Member>

In the present exemplary embodiment, the temperature-sensitive magnetic member 64 is ferromagnetic within a temperature range not greater than a temperature at which the magnetic permeability starts to change (permeability change start temperature). Accordingly, the temperature-sensitive magnetic member 64 starts self-heating by electromagnetic induction heating. The temperature of the fixing belt 61 herein decreases since the fixing belt 61 loses heat when performing fixation. However, the fixing belt 61 may be reheated by the heat generated by this temperature-sensitive magnetic member 64 along with the heat generated from the fixing belt 61 by the electromagnetic induction heating in the same manner. Accordingly, the temperature of the fixing belt 61 may be promptly increased to the fixation setting temperature.

The temperature-sensitive magnetic member 64 is formed into a circular arc shape corresponding with the inner peripheral surface of the fixing belt 61 and arranged in contact with the inner peripheral surface of the fixing belt 61. The reason for arranging the temperature-sensitive magnetic member 64 in contact with the fixing belt 61 is to allow the heat generated from the temperature-sensitive magnetic member 64 by electromagnetic induction heating to be easily supplied to the fixing belt 61. In addition, the temperature-sensitive magnetic member 64 is kept at a temperature higher than that of the fixing belt 61 by 20 degrees C. to 30 degrees C. in order to supply heat to the fixing belt 61.

Moreover, the temperature-sensitive magnetic member 64 is formed of a material whose "permeability change start temperature" (refer to later part of the description) at which the permeability of the magnetic properties drastically changes is not less than the fixation setting temperature at which each color toner image starts melting, and whose permeability change start temperature is also set within a temperature range lower than the heat-resistant temperatures of the elastic layer 613 and the surface release layer 614 of the fixing belt 61. Specifically, the temperature-sensitive magnetic member 64 is formed of a material having a property ("temperature-sensitive magnetic property") that reversibly changes between the ferromagnetic property and the non-magnetic property (paramagnetic property) in a temperature range including the fixation setting temperature. Thus, the temperature-sensitive magnetic member 64 functions as a magnetic path forming member in the temperature range not greater than the permeability change start temperature at which the temperature-sensitive magnetic member 64 presents the ferromagnetic property. Further, the temperature-sensitive magnetic member 64 induces magnetic field lines generated by the IH heater 80 and going through the fixing belt 61 to the inside thereof, and forms a magnetic path of an AC magnetic field (magnetic field lines) so that the magnetic field lines pass through the inside of the temperature-sensitive magnetic member 64. Thereby, the temperature-sensitive magnetic member 64 forms a closed magnetic path that internally wraps around the fixing belt 61 and an excitation coil 82 (refer to later-described FIG. 6) of the IH heater 80. Meanwhile, within a temperature range exceeding the permeability change start temperature, the temperature-sensitive magnetic member 64 causes the magnetic field lines generated by the IH heater 80 and going through the fixing belt 61 to go therethrough so as to run across the temperature-sensitive magnetic member 64 in the thickness direction of the temperature-sensitive magnetic member 64. Then, the magnetic field lines generated by the IH heater 80 and going through the fixing belt 61 form a magnetic path in which the magnetic field lines go through the temperature-sensitive magnetic member 64, and then go through the inside of the induction member 66 and return to the IH heater 80.

Note that, the "permeability change start temperature" herein refers to a temperature at which a permeability (permeability measured by JIS C2531, for example) starts decreasing continuously and refers to a temperature point at which the amount of the magnetic flux (the number of magnetic field lines) going through a member such as the temperature-sensitive magnetic member 64 starts to change, for example. Accordingly, the permeability change start temperature is a temperature close to the Curie point, which is a temperature at which the magnetic property of a substance is lost, but is a temperature with a concept different from the Curie point.

Examples of the material of the temperature-sensitive magnetic member 64 include a binary magnetism-adjusted steel such as a Fe—Ni alloy (permalloy) or a ternary magnetism-adjusted steel such as a Fe—Ni—Cr alloy whose permeability change start temperature is set within a range of 140 degrees C. (fixation setting temperature) to 240 degrees C. For example, the permeability change start temperature may be set around 225 degrees C. by setting the ratios of Fe and Ni at approximately 64% and 36% (atom number ratio), respectively, in a binary magnetism-adjusted steel of Fe—Ni. The aforementioned alloys or the like including the permalloy and the magnetism-adjusted steel are suitable for the temperature-sensitive magnetic member 64 since they are excellent in molding property and processability, and a high heat conductivity as well as less expensive costs. Examples of the other materials include an alloy made of Fe, Ni, Si, B, Nb, Cu, Zr, Co, Cr, V, Mn, Mo or the like.

In addition, the temperature-sensitive magnetic member 64 is formed with a thickness smaller than the skin depth δ (refer to the formula (1) described above) with respect to the AC magnetic field (magnetic field lines) generated by the IH heater 80. Specifically, a thickness of approximately 50 to 300 μm is set when a Fe—Ni alloy is used as the material, for example.

<Description of Frame>

The frame 65 that supports the pressing pad 63 is formed of a material having a high rigidity so that the amount of deflection in a state where the pressing pad 63 receives a pressing force from the pressure roll 62 may be a certain amount or less. In this manner, the amount of pressure (nip pressure) at the nip portion N in the longitudinal direction is kept uniform. Moreover, since the fixing unit 60 of the present exemplary embodiment employs a configuration in which the fixing belt 61 generates heat by use of electromagnetic induction, the frame 65 is formed of a material that provides no influence or hardly provides influence to an induction magnetic field, and that is not influenced or is hardly influenced by the induction magnetic field. For example, a heat-resistant resin such as glass mixed PPS (polyphenylene sulfide), or a paramagnetic metal material such as Al, Cu or Ag is used.

<Description of Induction Material>

In the present exemplary embodiment, the induction member 66 is formed into a circular arc shape corresponding with the inner peripheral surface of the temperature-sensitive magnetic member 64 and arranged to be in contact with the inner peripheral surface of the temperature-sensitive magnetic member 64. Then, when the temperature of the temperature-sensitive magnetic member 64 increases to the permeability change start temperature or higher, the induction member 66 induces the AC magnetic field (magnetic field lines) generated by the IH heater 80 to the inside thereof and forms a state where an eddy current I is easily generated than in the conductive heat-generating layer 612 of the fixing belt 61.

Magnetic field lines H after passing through the temperature-sensitive magnetic member 64 arrive at the induction member 66 and then are induced to the inside thereof. The material, thickness and shape of the induction member 66 are selected for inducing, at this time, most of the magnetic field lines H from the excitation coil 82 and suppressing the leak of the magnetic field lines H from the fixing unit 60. Specifically, the induction member 66 may be formed with a thickness set in advance (1.0 mm, for example) sufficiently larger than the skin depth δ (refer to the formula (1) described above) in order to allow the eddy current I to easily flow. Thereby, even when the eddy current I flows into the induction member 66, the amount of heat generated becomes extremely small. In the present exemplary embodiment, the induction member 66 is formed of aluminum (Al) having an approximately circular arc shape along the shape of the temperature-sensitive magnetic member 64 and with a thickness of 1 mm, and is arranged to be in contact with the inner peripheral surface of the temperature-sensitive magnetic member 64. As an example of the other materials, Ag or Cu may be particularly used.

Moreover, as described above, the induction member 66 has a function to induce the magnetic field lines having passed through the temperature-sensitive magnetic member 64, but also has a function to diffuse the heat generated at the temperature-sensitive magnetic member 64 as well. In actual fixing operations, the size of the sheet P passing through the fixing unit 60 varies. Therefore, the temperature at a portion where the sheet P has passed through, of the fixing belt 61 decreases because of loss of heat due to the fixing onto the sheet P. However, the temperature at a portion other than the portion where the sheet P has passed through, of the fixing belt 61 does not decrease much. Accordingly, the temperature distribution on the fixing belt 61 becomes non-uniform. For this reason, the non-uniform temperature distribution of the fixing belt 61 needs to be promptly cancelled and then made uniform by the induction member 66.

<Description of IH Heater>

Next, a description will be given of the IH heater 80 that induces the heat generation of the fixing belt 61 by electromagnetic induction with an action of an AC magnetic field in the conductive heat-generating layer 612 of the fixing belt 61.

Figure 6:
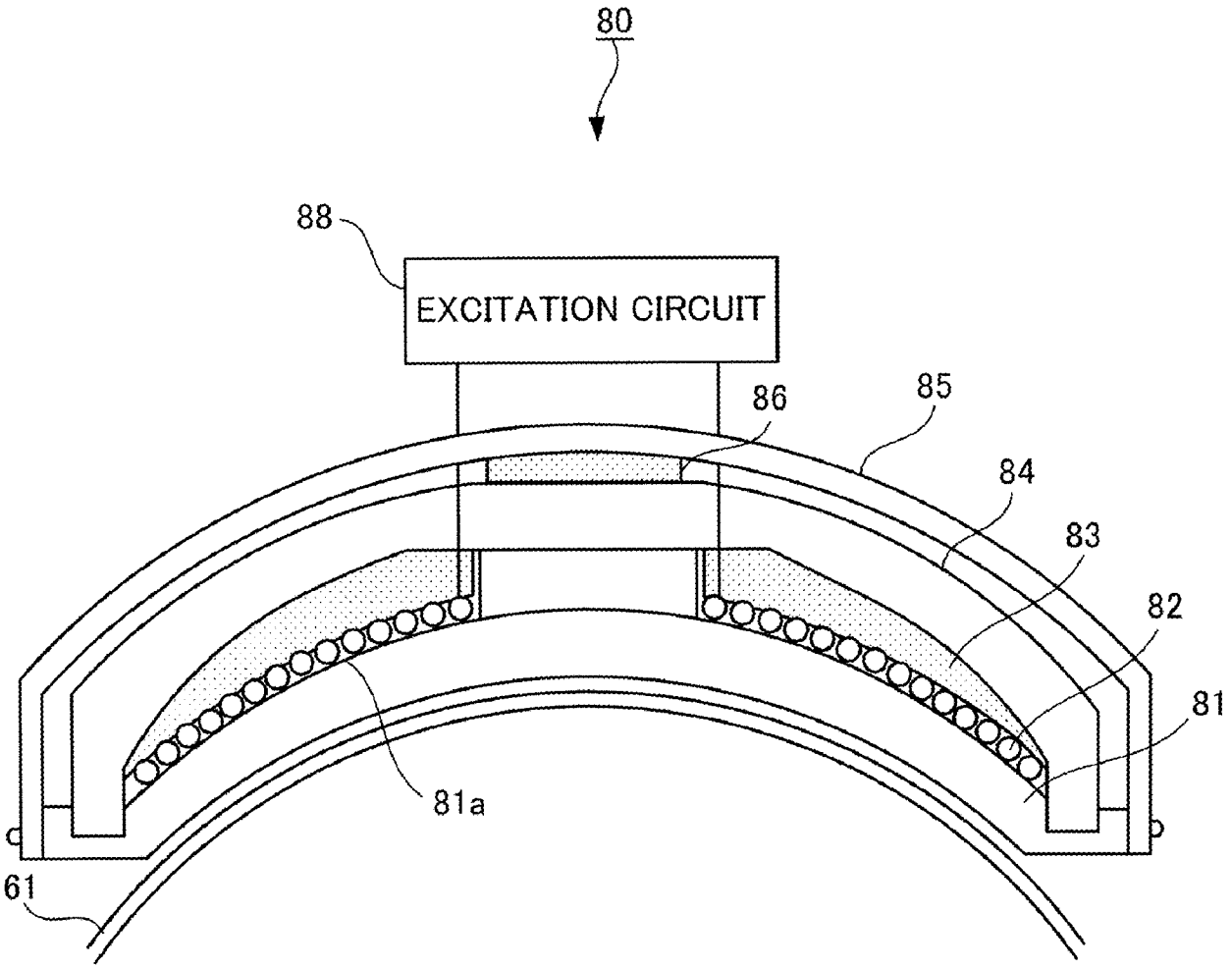
FIG. 6 is a cross sectional view for explaining a configuration of the IH heater.

FIG. 6 is a cross sectional view for explaining a configuration of the IH heater 80 of the exemplary embodiment. As shown in FIG. 6, the IH heater 80 includes: a support member 81 formed of a non-magnetic material such as a heat-resistant resin, for example; and the excitation coil 82 that generates an AC magnetic field. Moreover, the IH heater 80 includes: elastic support members 83 each formed of an elastic material that fixes the excitation coil 82 onto the support member 81; and a magnetic core 84 that forms a magnetic path of the AC magnetic field generated at the excitation coil 82. Furthermore, the IH heater 80 includes: a shield 85 that shields a magnetic field; a pressing member 86 that presses the magnetic core 84 toward the support member 81; and an excitation circuit 88 that supplies an AC current to the excitation coil 82.

The support member 81 is formed into a shape in which the cross section thereof is curved along the shape of the surface of the fixing belt 61, and is formed so as to keep a gap set in advance (0.5 to 2 mm, for example) between an upper surface (supporting surface) 81*a* that supports the excitation coil 82 and the surface of the fixing belt 61. In addition, examples of the material that forms the support member 81 include a heat-resistant non-magnetic material such as: a heat-resistant glass; a heat-resistant resin including polycarbonate, polyethersulphone or PPS (polyphenylene sulfide); and the heat-resistant resin containing a glass fiber therein.

The excitation coil 82 is formed by winding a litz wire in a closed loop of an oval shape, elliptical shape or rectangular shape having an opening inside, the litz wire being obtained by bundling 90 pieces of mutually isolated copper wires each having a diameter of 0.17 mm, for example. Then, when an AC current having a frequency set in advance is supplied from the excitation circuit 88 to the excitation coil 82, an AC magnetic field on the litz wire wound in a closed loop shape as the center is generated around the excitation coil 82. In general, a frequency of 20 kHz to 100 kHz, which is generated by the aforementioned general-purpose power supply, is used for the frequency of the AC current supplied to the excitation coil 82 from the excitation circuit 88.

As the material of the magnetic core 84, a ferromagnetic material, formed of an oxide or alloy material with a high permeability, such as a soft ferrite, a ferrite resin, a non-crystalline alloy (amorphous alloy), permalloy or a magnetism-adjusted steel is used. The magnetic core 84 functions as a magnetic path forming unit. The magnetic core 84 induces, to the inside thereof, the magnetic field lines (magnetic flux) of the AC magnetic field generated at the excitation coil 82, and forms a path (magnetic path) of the magnetic field lines in which the magnetic field lines from the magnetic core 84 run across the fixing belt 61 to be directed to the temperature-sensitive magnetic member 64, then pass through the inside of the temperature-sensitive magnetic member 64, and return to the magnetic core 84. Specifically, a configuration in which the AC magnetic field generated at the excitation coil 82 passes through the inside of the magnetic core 84 and the inside of the temperature-sensitive magnetic member 64 is employed, and thereby, a closed magnetic path where the magnetic field lines internally wrap the fixing belt 61 and the excitation coil 82 is formed. Thereby, the magnetic field lines of the AC magnetic field generated at the excitation coil 82 are concentrated at a region of the fixing belt 61, which faces the magnetic core 84.

Here, the material of the magnetic core 84 may be one that has a small amount of loss due to the forming of the magnetic path. Specifically, the magnetic core 84 may be particularly used in a form that reduces the amount of eddy-current loss (shielding or dividing of the electric current path by having a slit or the like, or bundling of thin plates, or the like). In addition, the magnetic core 84 may be particularly formed of a material having a small hysteresis loss.

The length of the magnetic core 84 along the rotation direction of the fixing belt 61 is formed so as to be shorter than the length of the temperature-sensitive magnetic member 64 along the rotation direction of the fixing belt 61. Thereby, the amount of leakage of the magnetic field lines toward the periphery of the IH heater 80 is reduced, resulting in improvement in the power factor. Moreover, the electromagnetic induction toward the metal materials forming the fixing unit 60 is also suppressed and the heat-generating efficiency at the fixing belt 61 (conductive heat-generating layer 612) increases.

<Description of a State in Which Fixing Belt Generates Heat>

Next, a description will be given of a state in which the fixing belt 61 generates heat by use of the AC magnetic field generated by the IH heater 80.

Firstly, as described above, the permeability change start temperature of the temperature-sensitive magnetic member 64 is set within a temperature range (140 to 240 degrees C., for example) where the temperature is not less than the fixation setting temperature for fixing color toner images and not greater than the heat-resistant temperature of the fixing belt 61. Then, when the temperature of the fixing belt 61 is not greater than the permeability change start temperature, the temperature of the temperature-sensitive magnetic member 64 near the fixing belt 61 corresponds to the temperature of the fixing belt 61 and then becomes equal to or lower than the permeability change start temperature. For this reason, the temperature-sensitive magnetic member 64 has a ferromagnetic property at this time, and thus, the magnetic field lines H of the AC magnetic field generated by the IH heater 80 form a magnetic path where the magnetic field lines H go through the fixing belt 61 and thereafter, pass through the inside of the temperature-sensitive magnetic member 64 along a spreading direction. Here, the "spreading direction" refers to a direction orthogonal to the thickness direction of the temperature-sensitive magnetic member 64.

Figure 7:
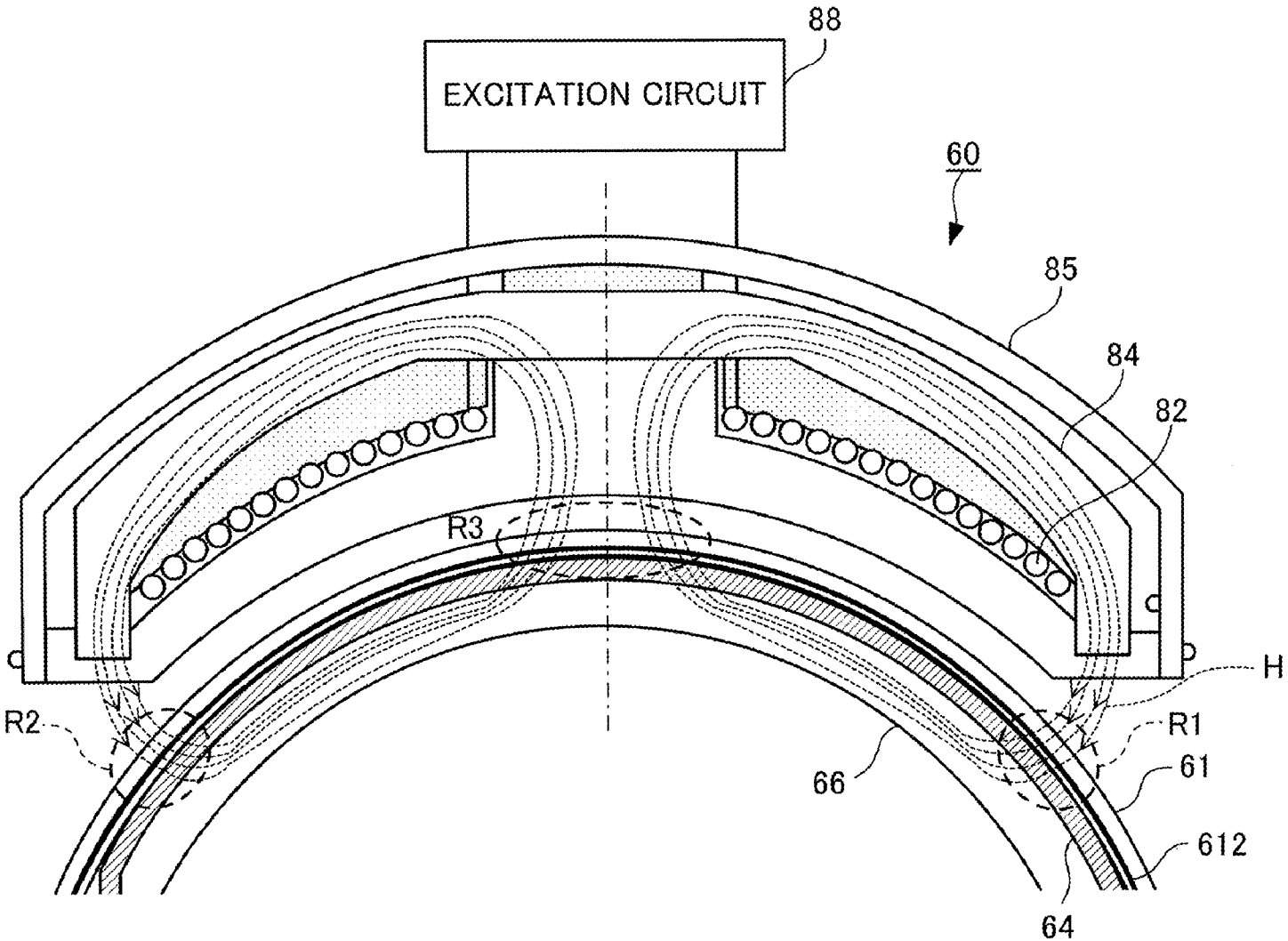
FIG. 7 is a diagram for explaining the state of the magnetic field lines H in a case where the temperature of the fixing belt is within a temperature range not greater than the permeability change start temperature.

FIG. 7 is a diagram for explaining the state of the magnetic field lines H in a case where the temperature of the fixing belt 61 is within a temperature range not greater than the permeability change start temperature. As shown in FIG. 7, in the case where the temperature of the fixing belt 61 is within a temperature range not greater than the permeability change start temperature, the magnetic field lines H of the AC magnetic field generated by the IH heater 80 form a magnetic path where the magnetic field lines H intersect with and go through the fixing belt 61, and then pass through the inside of the temperature-sensitive magnetic member 64 in the spreading direction (direction orthogonal to the thickness direction). Accordingly, the number of the magnetic field lines H (density of magnetic flux) in unit area in the region where the magnetic field lines H run across the conductive heat-generating layer 612 of the fixing belt 61 becomes large.

Specifically, after the magnetic field lines H are radiated from the magnetic core 84 of the IH heater 80 and pass through regions R1 and R2 where the magnetic field lines H run across the conductive heat-generating layer 612 of the fixing belt 61, the magnetic field lines H are induced to the inside of the temperature-sensitive magnetic member 64, which is a ferromagnetic member. For this reason, the magnetic field lines H running across the conductive heat-generating layer 612 of the fixing belt 61 in the thickness direction are concentrated so as to enter the inside of the temperature-sensitive magnetic member 64. Accordingly, the magnetic flux density becomes high in the regions R1 and R2. In addition, in a case where the magnetic field lines H passing through the inside of the temperature-sensitive magnetic member 64 along the spreading direction return to the magnetic core 84, in a region R3 where the magnetic field lines H run across the conductive heat-generating layer 612 in the thickness direction, the magnetic field lines H are generated toward the magnetic core 84 in a concentrated manner from a portion, where the magnetic potential is low, of the temperature-sensitive magnetic member 64. For this reason, the magnetic field lines H running across the conductive heat-generating layer 612 of the fixing belt 61 in the thickness direction move from the temperature-sensitive magnetic member 64 toward the magnetic core 84 in a concentrated manner, so that the magnetic flux density in the region R3 becomes high as well.

In the conductive heat-generating layer 612 of the fixing belt 61 which the magnetic field lines H run across in the thickness direction, the eddy current I proportional to the amount of change in the number of the magnetic field lines H (magnetic flux density) in unit area is generated. Thereby, as shown in FIG. 7, a larger eddy current I is generated in the regions R1, R2 and R3 where a large amount of change in the magnetic flux density occurs. The eddy current I generated in the conductive heat-generating layer 612 generates a Joule heat W ($W=I^2R$), which is multiplication of the specific resistant value R and the square of the eddy current I of the conductive heat-generating layer 612. Accordingly, a large Joule heat W is generated in the conductive heat-generating layer 612 where the larger eddy current I is generated.

As described above, in a case where the temperature of the fixing belt 61 is within a temperature range not greater than the permeability change start temperature, a large amount of heat is generated in the regions R1, R2 and R3 where the magnetic field lines H run across the conductive heat-generating layer 612, and thereby the fixing belt 61 is heated.

Incidentally, in the fixing unit 60 of the present exemplary embodiment, the temperature-sensitive magnetic member 64 is arranged at the inner peripheral side of the fixing belt 61 while being in contact with the fixing belt 61, thereby, providing the configuration in which the magnetic core 84 inducing the magnetic field lines H generated at the excitation coil 82 to the inside thereof, and the temperature-sensitive magnetic member 64 inducing the magnetic field lines H running across and going through the fixing belt 61 in the thickness direction are arranged to be close to each other. For this reason, the AC magnetic field generated by the IH heater 80 (excitation coil 82) forms a loop of a short magnetic path, so that the magnetic flux density and the degree of magnetic coupling in the magnetic path increase. Thereby, heat is more efficiently generated in the fixing belt 61 in a case where the temperature of the fixing belt 61 is within a temperature range not greater than the permeability change start temperature.

[Description of Drive Mechanism of Fixing Belt]

Next, a description will be given of a drive mechanism of the fixing belt 61.

As shown in FIG. 2, which is a front view, end caps 67 are fixed to both ends in the axis direction of the frame 65 (refer to FIG. 3), respectively. The end caps 67 rotationally drive the fixing belt 61 in a peripheral direction while keeping cross sectional shapes of both ends of the fixing belt 61 in a circular shape. Then, the fixing belt 61 directly receives rotational drive force via the end caps 67 at the both ends and rotationally moves at, for example, a process speed of 140 mm/s in a direction of an arrow C in FIG. 3

Figure 5A:
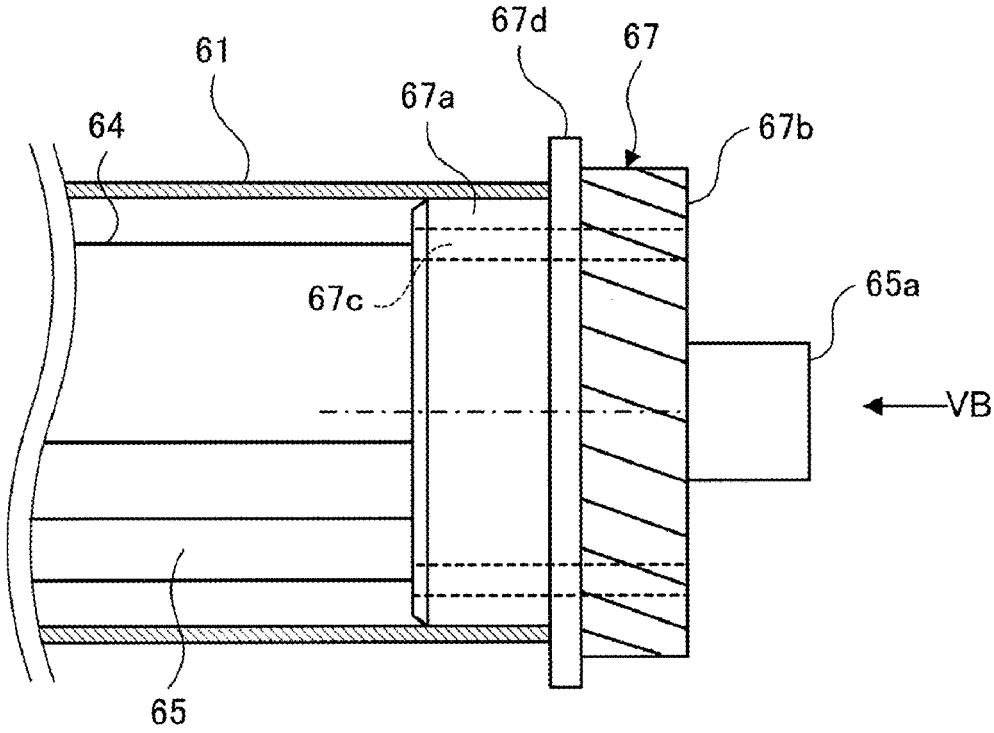
FIG. 5A is a side view of one of the end caps.
Figure 5B:
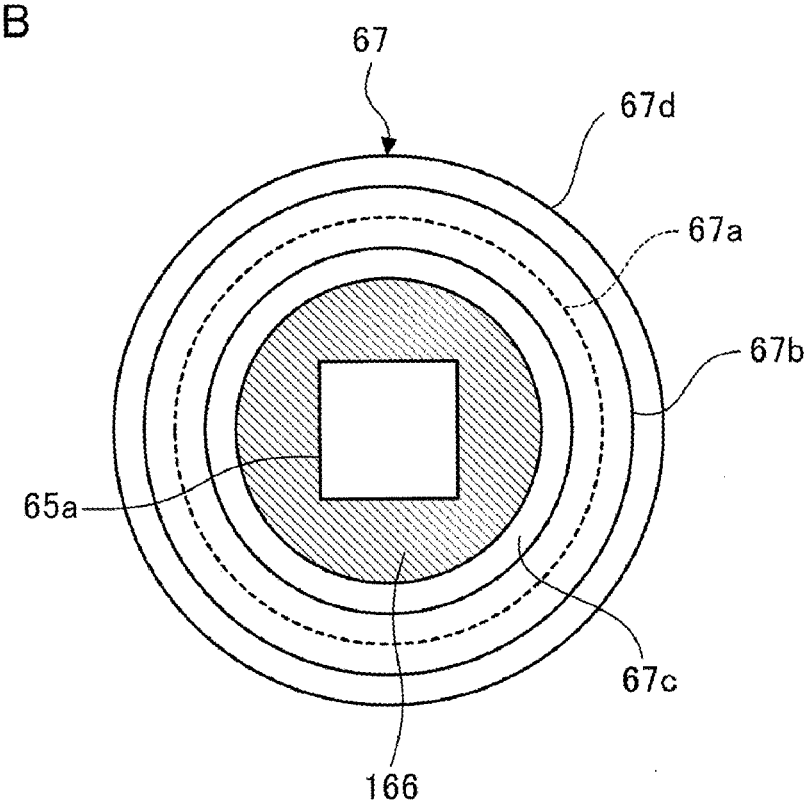
FIG. 5B is a plan view of the end cap when viewed from a VB direction of FIG. 5A.

Here, FIG. 5A is a side view of one of the end caps 67, and FIG. 5B is a plan view of the end cap 67 when viewed from a VB direction of FIG. 5A. As shown in FIGS. 5A and 5B, the end cap 67 includes: a fixing unit 67*a* that is fitted into the inside of a corresponding one of the ends of the fixing belt 61; a flange 67*d* that has an outer diameter formed to be larger than that of the fixing unit 67*a* and that is formed so as to project from the fixing belt 61 in the radial direction when attached to the fixing belt 61; a gear 67*b* to which the rotational drive force is transmitted; and a bearing unit 67*c* that is rotatably connected to a support member 65*a* formed at a corresponding one of the ends of the frame 65 with a connection member 166 interposed therebetween. Then, as shown in FIG. 2, the support members 65*a* at the both ends of the frame 65 are fixed onto the both ends of a chassis 69 of the fixing unit 60, respectively, thereby, supporting the end caps 67 so as to be rotatable with the bearing units 67*c* respectively connected to the support members 65*a*.

As the material of the end caps 67, so called engineering plastics having a high mechanical strength or heat-resistant properties is used. For example, a phenol resin, polyimide resin, polyamide resin, polyamide-imide resin, PEEK resin, PES resin, PPS resin, LCP resin or the like are suitable.

Then, as shown in FIG. 2, in the fixing unit 60, a rotational drive force from a drive motor 90 as an example of a drive unit is transmitted to a shaft 93 via transmission gears 91 and 92. The rotational drive force is then transmitted from transmission gears 94 and 95 connected to the shaft 93 to the gears 67*b* of the respective end caps 67 (refer to FIGS. 5A and 5B). Thereby, the rotational drive force is transmitted from the end caps 67 to the fixing belt 61, and the end caps 67 and the fixing belt 61 are integrally rotationally driven.

As described above, the fixing belt 61 directly receives the drive force at the both ends of the fixing belt 61 to rotate, thereby rotating stably.

Here, a torque of approximately 0.1 to 0.5 N·m is generally exerted when the fixing belt 61 directly receives the drive force from the end caps 67 at the both ends thereof and then rotates. However, in the fixing belt 61 of the present exemplary embodiment, the base material layer 611 is formed of, for example, a non-magnetic stainless steel having a high mechanical strength. Thus, buckling or the like does not easily occur on the fixing belt 61 even when a torsional torque of approximately 0.1 to 0.5 N·m is exerted on the entire fixing belt 61.

In addition, the fixing belt 61 is prevented from inclining or leaning to one direction by the flanges 67*d* of the end caps 67, but at this time, compressive force of approximately 1 to 5 N is exerted toward the axis direction from the ends (flanges 67*d*) on the fixing belt 61 in general. However, even in a case where the fixing belt 61 receives such compressive force, the occurrence of buckling or the like is prevented since the base material layer 611 of the fixing belt 61 is formed of a non-magnetic stainless steel or the like.

As described above, the fixing belt 61 of the present exemplary embodiment receives the drive force directly at the both ends of the fixing belt 61 to rotate, thereby, rotating stably. In addition, the base material layer 611 of the fixing belt 61 is formed of, for example, a non-magnetic stainless steel or the like having a high mechanical strength, hence providing the configuration in which buckling or the like caused by a torsion torque or a compressive force does not easily occur in this case. Moreover, the softness and flexibility of the entire fixing belt 61 is secured by forming the base material layer 611 and the conductive heat-generating layer 612 respectively as thin layers, so that the fixing belt 61 is deformed so as to correspond with the nip portion N and recovers to the original shape.

With reference back to FIG. 3, the pressure roll 62 is arranged facing the fixing belt 61 and rotates at, for example, a process speed of 140 mm/s in the direction of the arrow D in FIG. 3 while being driven by the fixing belt 61. Then, the nip portion N is formed in a state where the fixing belt 61 is held between the pressure roll 62 and the pressing pad 63. Then, while the sheet P holding an unfixed toner image is caused to pass through this nip portion N, heat and pressure is added to the sheet P, and thereby, the unfixed toner image is fixed onto the sheet P.

The pressure roll 62 is formed of a multi-layer including: a solid aluminum core (cylindrical core metal) 621 having a diameter of 18 mm, for example; a heat-resistant elastic layer 622 that covers the outer peripheral surface of the core 621, and that is made of silicone sponge having a thickness of 5 mm, for example; and a release layer 623 that is formed of a heat-resistant resin such as PFA containing carbon or the like, or a heat-resistant rubber, having a thickness of 50 μm, for example, and that covers the heat-resistant elastic layer 622. Then, the pressing pad 63 is pressed under a load of 25 kgf, for example, by pressing springs 68 (refer to FIG. 2) with the fixing belt 61 therebetween.

Meanwhile, the heat-resistant elastic layer 622 and the release layer 623 of the pressure roll 62, except the core 621, are formed of relatively soft materials as described above. For this reason, if the pressure roll 62 is left in a state where the pressure roll 62 presses the pressing pad 63 with the fixing belt 61 therebetween even when fixation is not performed, the pressure roll 62 may become unrecoverable to the original shape. Specifically, the pressure roll 62 deforms and remains in a shape formed by the nip portion N. In this case, the amount of pressing force applied to the nip portion N becomes different from the originally designed amount. Thus, the fixation is not performed in accordance with the specification, which results in loss of performance of the fixing unit 60.

[Description of Moving Mechanism of Pressure Roll]

Accordingly, in order to prevent the occurrence of the aforementioned case, a moving mechanism not shown in the figure is provided to the pressure roll 62, and an operation to separate the pressure roll 62 from the fixing belt 61 is performed during a period other than when fixation is performed. Specifically, when fixation is performed, the pressure roll 62 is brought into contact with and pressed against an outer peripheral surface of the fixing belt 61 and forms the nip portion N for inserting a recording medium holding an unfixed toner image thereon between the pressure roll 62 and the fixing belt 61. On the other hand, when fixation is not performed, the pressure roll 62 moves so as to separate from the fixing belt 61.

Figure 8:
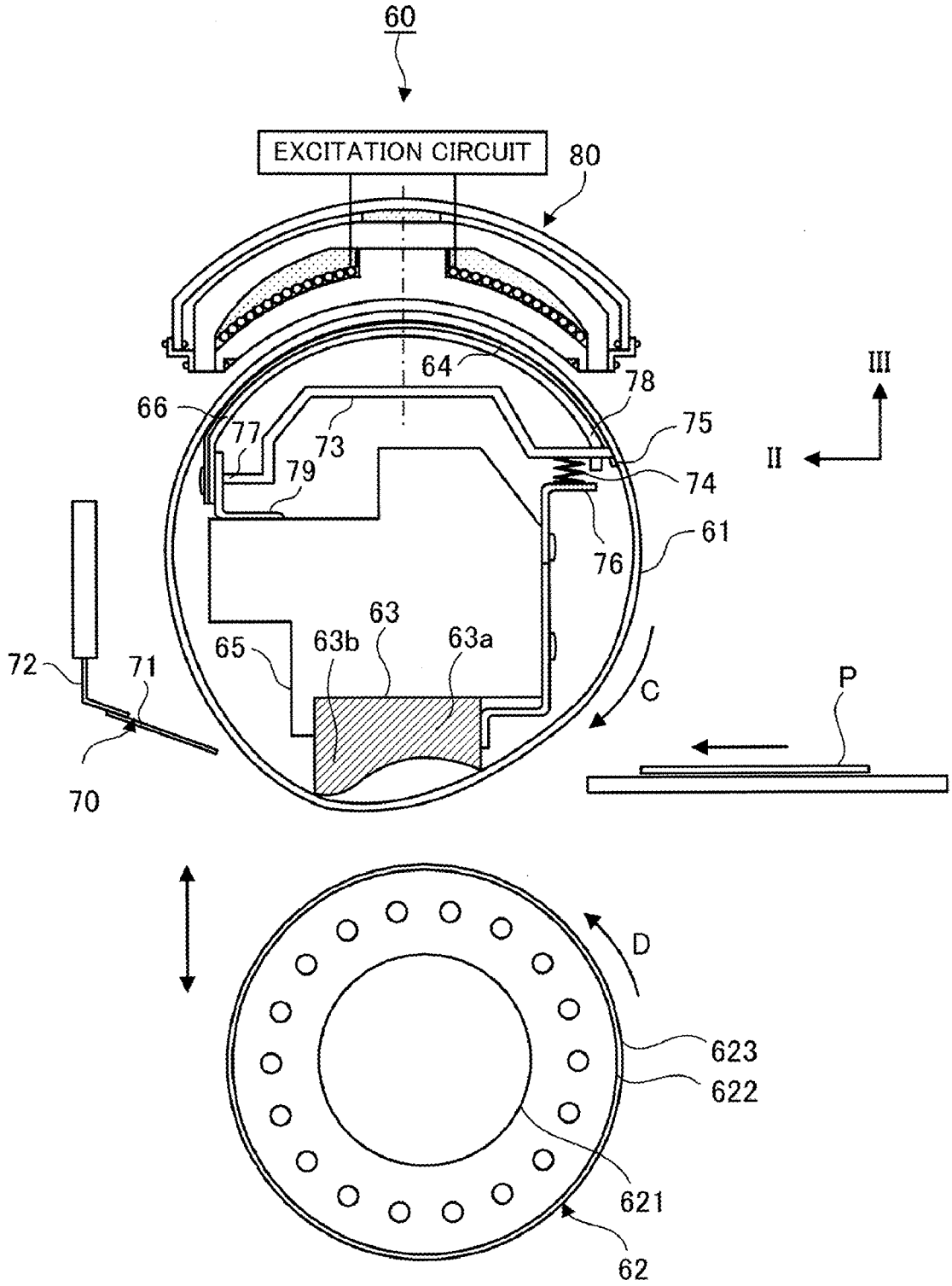
FIG. 8 is a diagram for explaining the state in which the pressure roll is separated from the fixing belt by the moving mechanism.

FIG. 8 is a diagram for explaining the state in which the pressure roll 62 is separated from the fixing belt 61 by the moving mechanism.

As shown in FIG. 8, the pressure roll 62 and the fixing belt 61 are in the state of being separate from each other. For this reason, the shape of the pressure roll 62 recovers to the original circular shape, so that the pressure roll 62 is less likely to deform and to become unrecoverable to the original shape.

Note that, when fixation is performed, the pressure roll 62 may be brought into contact with the fixing belt 61 again by the moving mechanism, and return to the position to form the nip portion N as described in FIG. 3. A controller not shown in the figure performs the aforementioned moving operations by monitoring the state of the fixing unit 60 and determining whether or not fixation should be performed.

Here, in the state where the pressure roll 62 is separated from the fixing belt 61 as shown in FIG. 8, normally, the shape of the fixing belt 61 is in an elliptical shape. On the other hand, the shape of the fixing belt 61 described in FIG. 3 is in substantially a circular shape. Specifically, the shape of the fixing belt 61 repeatedly changes between the elliptical shape and the circular shape because of repeating operation in which the pressure roll 62 and the fixing belt 61 are brought into contact with each other and then are separated from each other by the moving mechanism. In this case, an edge 75 on the downstream side of the temperature-sensitive magnetic member 64 in the rotational direction of the fixing belt 61 is brought into contact with the fixing belt 61 and then separates from the fixing belt 61, and the above operation is repeatedly performed. As a result, an inner surface of the fixing belt 61 may be damaged. In a case where the inner surface of the fixing belt 61 is damaged, the damage may further spread, hence causing a crack on the conductive heat-generating layer 612 (refer to FIG. 4) in some cases. If the fixing belt 61 is damaged in the aforementioned manner, the fixing belt 61 does not generate the heat in accordance with the designed specification. Moreover, distribution of the heat on the fixing belt 61 becomes non-uniform.

In order to prevent the fixing belt 61 from being damaged in the above described manner, it is conceivable to move and arrange the position of the temperature-sensitive magnetic member 64 to a lower position in FIGS. 3 and 8. In this case, the fixing belt 61 is prevented from being in contact with the edge 75 of the temperature-sensitive magnetic member 64. However, the degree of contact between the temperature-sensitive magnetic member 64 and the fixing belt 61 becomes weak in this case, so that the heat generated at the temperature-sensitive magnetic member 64 is not easily transmitted to the fixing belt 61. For this reason, it becomes difficult to maintain the temperature of the fixing belt 61 and also to maintain the uniformity of the temperature distribution.

In this respect, the elastic member 74 is provided in the present exemplary embodiment, and the state in which the temperature-sensitive magnetic member 64 and the fixing belt 61 are brought in contact with each other is kept by pressing the temperature-sensitive magnetic member 64 against the fixing belt 61 with the pressing effect exerted by this elastic member 74, thereby, addressing this problem.

[Description of Elastic Member]

Hereinafter, a description will be given of the elastic member 74 and the effects thereof in more details.

As shown in FIGS. 3 and 8, the elastic member 74 is arranged between an elastic member holder 76 and the magnetic path shielding member 73. In addition, an edge 77, which is one edge of the magnetic path shielding member 73, is fixed by a fixing holder 79 attached to the frame 65. The fixing holder 79 also fixes one end of each of the temperature-sensitive magnetic member 64 and the induction member 66, the one end being positioned on the upstream side in the rotational direction of the fixing belt 61. Then, the other end of the magnetic path shielding member 73, which is an edge 78, is connected to the temperature-sensitive magnetic member 64 and the induction member 66.

In this configuration, since the magnetic path shielding member 73 is formed of aluminum or the like and is elastic, the edge 78 is vertically movable with respect to the edge 77 as the supporting point. In addition, the elastic member 74 generates force in a III direction, which is an upper direction when viewed in FIGS. 3 and 8. With this force, the edge 78 of the magnetic path shielding member 73 moves up in the III direction. Since the magnetic path shielding member 73, the temperature-sensitive magnetic member 64 and the induction member 66 are connected to one another at the portion of the edge 78 of the magnetic path shielding member 73, the force generated by the elastic member 74 is exerted as force to press the temperature-sensitive magnetic member 64 and the induction member 66 in a direction toward the fixing belt 61. As a result, the temperature-sensitive magnetic member 64 is in a state of being pressed against the fixing belt 61. Specifically, even if the pressure roll 62 is brought into contact with the fixing belt 61 and separated from the fixing belt 61, by the moving mechanism, and this operation is repeated as described above, the temperature-sensitive magnetic member 64 is kept in the state of being pressed against the fixing belt 61. For this reason, the change in the shape of the fixing belt 61 is subtle, and the shape thereof is kept in substantially a circular shape. In other words, the fixing belt 61 is prevented from being deformed. As a result, the state in which the fixing belt 61 and the temperature-sensitive magnetic member 64 are in contact with each other does not easily change. Accordingly, damage on the fixing belt 61 stemming from damage on the inner surface of the fixing belt 61 at the edge 75 of the temperature-sensitive magnetic member 64 does not easily occur.

Furthermore, the induction member 66 as well moves in a direction of the pressing force applied thereto by the temperature-sensitive magnetic member 64, and thus, the state in which the temperature-sensitive magnetic member 64 and the induction member 66 are in contact with each other does not easily change. For this reason, the state of the formation of the magnetic path does not easily change, and also, the thermal diffusion effect exerted by the induction member 66 does not easily change. Accordingly, even in the state where the pressuring roll 62 is separated from the fixing belt 61 or brought into contact with the fixing belt 61, by the moving mechanism, the state where the fixing belt 61, the temperature-sensitive magnetic member 64 and the induction member 66 are mutually in contact with one another is kept. As a result, when the pressure roll 62 returns to the state of being in contact with the fixing belt 61 by the moving mechanism for performing a fixing operation, the state in which the heat generated by the temperature-sensitive magnetic member 64 is supplied to the fixing belt 61 does not easily change, hence allowing the fixing operation to be started promptly.

Moreover, since the state in which the fixing belt 61, the temperature-sensitive magnetic member 64 and the induction member 66 are mutually in contact with one another is kept, the heat does not easily spread outside. Accordingly, the temperatures of the fixing belt 61, the temperature-sensitive magnetic member 64 and the induction member 66 do not easily change even when the fixing operation is not performed. For this reason, with this point as well, not only the fixing operation is started promptly, but also energy saving is achievable. Moreover, a stable operation of the fixing unit 60 is achieved, hence providing the image forming apparatus 1 (refer to FIG. 1) capable of stably maintaining a higher quality image.

Note that, the elastic member 74 is not limited to any particular member, and a plate spring, coil spring or the like may be used as the elastic member 74. However, a coil spring may be particularly used since coil springs are easily assembled, and allow freedom in design. In addition, the attached position of the elastic member 74 is not limited to any particular position as long as the position allows the elastic member 74 to press the temperature-sensitive magnetic member 64 and the induction member 66 against the fixing belt 61. Note that, it is at the downstream side in the rotational direction of the fixing belt 61 that the shape of the fixing belt 61 is likely to change when the pressure roll 62 is separated from the fixing belt 61 by the aforementioned moving mechanism. In addition, for preventing the fixing belt 61 from being damaged by the aforementioned edge 75 on the downstream side of the temperature-sensitive magnetic member 64, the elastic member 74 may be particularly arranged at the edge 75 of the temperature-sensitive magnetic member 64 or a position adjacent to the edge 75 on the downstream side thereof in the rotational direction of the fixing belt 61.

In addition, in the aforementioned example, the edge 77, which is one edge of the magnetic path shielding member 73, is fixed. However, the present exemplary embodiment is not limited to a case where the edge 77 is completely fixed by adhesion, welding, screw fastening or the like, but includes a case where the edge 77 is fixed by fitting or the like with some margin. In this case, the assembly is likely to be easier.

Figure 9:
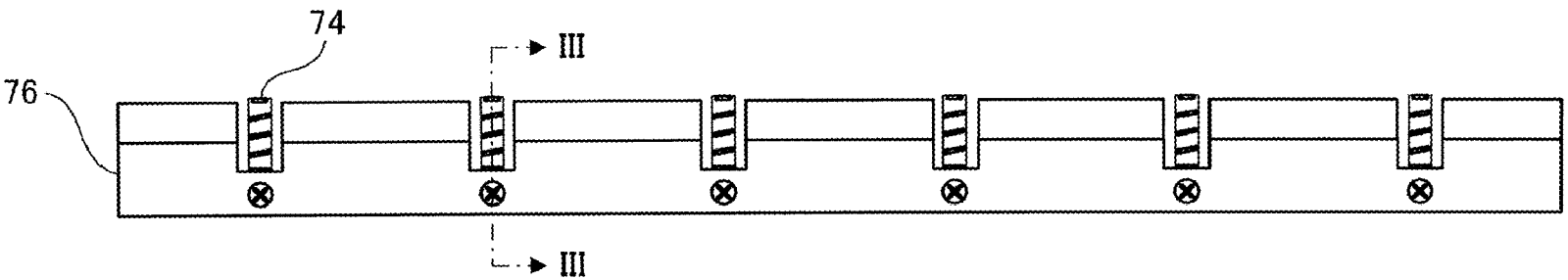
FIG. 9 is a diagram showing the portions of the elastic member holder and the elastic member when viewed in a II direction in FIGS. 3 and 8.

FIG. 9 is a diagram showing the portions of the elastic member holder 76 and the elastic member 74 when viewed in an II direction in FIGS. 3 and 8. Here, for the purpose of simplifying the description, the temperature-sensitive magnetic member 64, the induction member 66 and the like are not illustrated. Note that, FIGS. 3 and 8 show the elastic member holder 76 and the elastic member 74 when viewed in a III-III cross section in FIG. 9.

In the example shown in FIG. 9, a coil spring is used as the elastic member 74. Multiple coil springs are arranged on the elastic member holder 76 in the rotational axis direction of the fixing belt 61. In the example shown in FIG. 9, six coil springs each being as the elastic member 74 are provided and arranged at approximately equal intervals. When the multiple coil springs are provided in this manner, large force may be generated with a small amount of displacement even in a case where small coil springs need to be used due a limitation of the attachment space. Moreover, when the coil springs are arranged in such a distributed manner, the force may be generated more uniformly. For this reason, the temperature-sensitive magnetic member 64 and the induction member 66 may be more smoothly moved in a direction to press against the fixing belt 61.

Figure 10B:
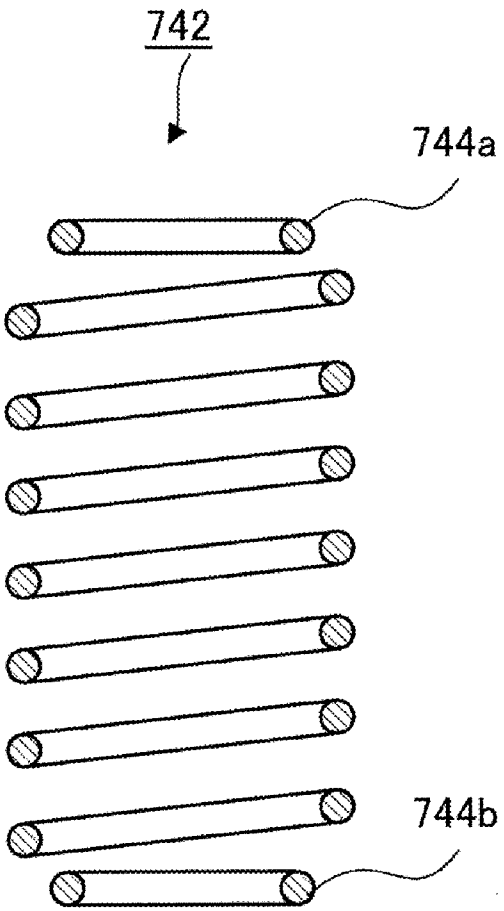
FIGS. 10A and 10B are cross sectional views for explaining the coil spring as the elastic member in further details.
Figure 10A:
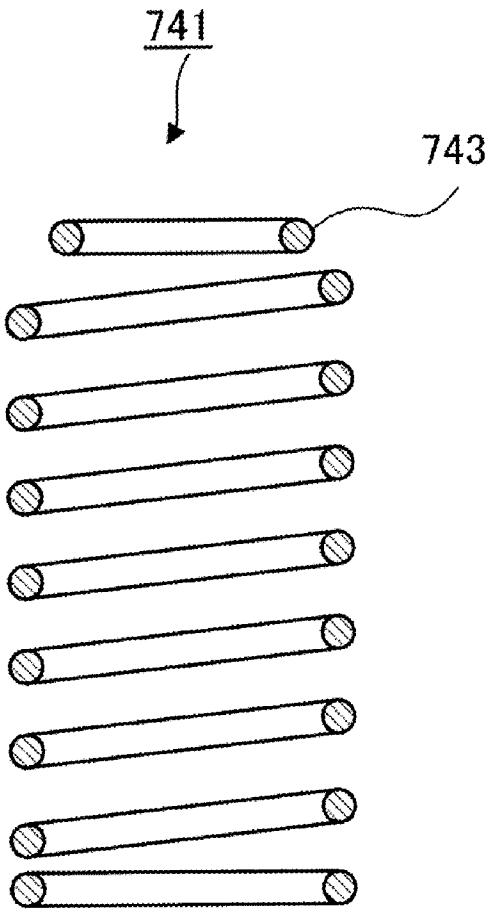

FIGS. 10A and 10B are cross sectional views for explaining the coil spring as the elastic member 74 in further details.

The coil spring preferably includes at least one end, of both ends, having a narrower coil diameter shape. Then, a coil spring 741 shown in FIG. 10A is an example of the coil spring provided with only one end formed into the narrower coil diameter shape. In addition, a coil spring 742 shown in FIG. 10B is an example of the coil spring provided with both ends formed into the narrower coil diameter shape. Note that, the narrower coil diameter shape herein refers to a shape in which the diameter of a coil partially forming the coil spring is made smaller than those of the others. In the case of the coil spring 741, a coil 743 is formed into the narrower coil diameter shape, and in the case of the coil spring 742, coils 744*a* and 744*b* are formed into the narrower coil diameter shape.

As described above, the coil spring provided with at least one of both ends formed into the narrower coil diameter shape makes arrangement of the coil spring easier. Specifically, a hole is formed in the magnetic path shielding member 73, for example, and the tip of the coil spring having the narrower coil diameter shape is inserted into this hole at the time of assembly. The size of the hole is defined as a size allowing the tip formed into the narrower coil diameter shape to be inserted thereinto, but not allowing coils at the center portion, which are not formed into the narrower coil diameter shape.

Thereby, the coil spring is fixed at the hole in a state of being fitted into the hole. Thus, in the case where only a small coil spring is usable because of the above-described reason, positioning of the coil spring and the magnetic path shielding member 73 is made easier. Thus, assembly is performed easily.

Note that, although only one end of both ends of the coil spring may be formed into the narrower coil diameter shape, the both ends may be particularly formed into the narrower coil diameter shape. Specifically, when only one end of the both ends is formed into the narrower coil diameter shape, at the time of the aforementioned assembly, the coil needs to be arranged so that the tip formed into the narrower coil diameter shape is placed on the magnetic path shielding member 73 side. On the other hand, when the both ends are formed into the narrower coil diameter shape, the direction of the coil spring does not have to be considered at the time of attachment of the coil spring.

As the diameter of the coil spring, the diameter of coils at the center portion, which are not formed into the narrower coil diameter shape, is 2 mm to 5 mm, for example. The diameter of a coil formed into the narrower coil diameter shape is 1 mm to 4 mm, for example. The length of the coil spring may be 5 mm to 10 mm, for example. Moreover, the number of winding of the coil spring may be 5 to 10. In addition, as to the spring constant, a coil spring that generates force of 0.1 N/mm to 1 N/mm is usable. The values described above may be selected in consideration of the pressing force required for the coil spring, a limitation of the amount of displacement, the number of coil springs to be attached and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that includes a conductive layer and that fixes toner onto a recording medium with the conductive layer self-heated by electromagnetic induction;

a drive unit that rotationally drives the fixing member;

a magnetic field generating member that generates an alternate-current magnetic field intersecting with the conductive layer of the fixing member;

a magnetic path forming member that is arranged so as to be in contact with an inner peripheral surface of the fixing member, that forms a magnetic path of the alternate-current magnetic field generated by the magnetic field generating member, and that transmits heat to the fixing member by being self-heated by electromagnetic induction;

an induction member that is arranged so as to be in contact with an inner peripheral surface of the magnetic path forming member, that induces magnetic field lines having passed through the magnetic path forming member and that diffuses heat generated at the magnetic path forming member; and an elastic member that has force in a direction to press the magnetic path forming member and the induction member against the inner peripheral surface of the fixing member.

2. The fixing device according to claim 1, wherein the elastic member is arranged, at any one of a position of an edge of the magnetic path forming member and a position adjacent to the edge, on a downstream side with respect to a rotational direction of the fixing member.

3. The fixing device according to claim 1, wherein the elastic member is a coil spring.

4. The fixing device according to claim 3, wherein at least one of ends of the coil spring is formed into a narrower coil diameter shape.

5. The fixing device according to claim 1, wherein the magnetic path forming member and the induction member each include one edge that is secured, and that is located on an upstream side in the rotational direction of the fixing member.

6. An image forming apparatus comprising:

a toner image forming unit that forms a toner image;

a transfer unit that transfers the toner image formed by the toner image forming unit onto a recording medium;

a fixing unit including:

a fixing member that includes a conductive layer and that fixes toner on the recording medium with the conductive layer self-heated by electromagnetic induction;

a drive unit that rotationally drives the fixing member;

a fixing and pressing member that forms a fixing nip portion for inserting the recording medium holding an unfixed image thereon between the fixing and pressing member and the fixing member by being brought into contact with and pressed against an outer peripheral surface of the fixing member, and thus is brought into contact with and pressed against the fixing member, when fixation is performed, and that moves so as to be separated from the fixing member when fixation is not performed;

a magnetic field generating member that generates an alternate-current magnetic field intersecting with the conductive layer of the fixing member;

a magnetic path forming member that is arranged so as to be in contact with an inner peripheral surface of the fixing member, that forms a magnetic path of the alternate-current magnetic field generated by the magnetic field generating member and that transmits heat to the fixing member by being self-heated by electromagnetic induction;

an induction member that is arranged so as to be in contact with an inner peripheral surface of the magnetic path forming member, that induces magnetic field lines passing through the magnetic path forming member and that diffuses heat generated at the magnetic path forming member; and an elastic member that generates force in a direction to press the magnetic path forming member and the induction member against the inner peripheral surface of the fixing member; and a controller that controls movement of the fixing and pressing member of the fixing unit.

7. The image forming apparatus according to claim 6, wherein the elastic member of the fixing unit is arranged, at any one of a position of an edge of the magnetic path forming member of the fixing unit and a position adjacent to the edge, on a downstream side with respect to a rotational direction of the fixing member of the fixing unit.

8. The image forming apparatus according to claim 6, wherein the elastic member of the fixing unit is a coil spring.

9. The image forming apparatus according to claim 8, wherein at least one of ends of the coil spring is formed into a narrower coil diameter shape.

10. The image forming apparatus according to claim 6, wherein the magnetic path forming member and the induction member of the fixing unit each include one edge that is secured, and that is located on an upstream side in the rotational direction of the fixing member of the fixing unit.

11. The image forming apparatus according to claim 6, wherein the elastic member of the fixing unit suppresses deformation of the fixing member of the fixing unit due to the movement of the fixing and pressing member of the fixing unit.

* * * * *